US005515816A

United States Patent [19]

Ball et al.

[11] Patent Number: 5,515,816

[45] Date of Patent: May 14, 1996

[54] ELECTRICAL GENERATOR SET

[76] Inventors: Ronald Ball, 3639 Haven Ave., Menlo Park, Calif. 94025; William Eldredge, 1 Uccelli Blvd., Redwood City, Calif. 94063

[21] Appl. No.: 436,768

[22] Filed: May 8, 1995

[51] Int. Cl.[6] ..... F01P 1/02

[52] U.S. Cl. ..... 123/41.7; 123/2; 123/195 C; 290/1 B

[58] Field of Search ..... 123/2, 195 C, 123/198 E, 41.7; 290/1 A, 1 B

[56] References Cited

U.S. PATENT DOCUMENTS

| | | | |
|---|---|---|---|
| 4,608,946 | 9/1986 | Tanaka et al. | 290/1 B |
| 4,835,405 | 5/1989 | Clancey et al. | 290/1 B |
| 4,856,470 | 8/1989 | Ishii et al. | 123/195 C |

FOREIGN PATENT DOCUMENTS

| | | | |
|---|---|---|---|
| 74327 | 4/1984 | Japan | 123/195 C |

*Primary Examiner*—Noah P. Kamen
*Attorney, Agent, or Firm*—Paul F. Schenck

[57] ABSTRACT

The compact electrical generator set has separate cooling airflows for the cylinder of the driving internal combustion engine, for the electrical generator, and for the crankcase of the internal combustion engine and the general interior of the enclosure of the electrical generator set. An optional fourth cooling airflow is dedicated to the oil cooler of the driving engine. Providing separate airflows allows to reduce the size of the enclosure. Noise generated by the engine exhaust is reduced by enveloping the exhaust gases with cooling air at the location were the exhaust gases exit the enclosure.

11 Claims, 4 Drawing Sheets

ELECTRICAL GENERATOR SET

BACKGROUND OF THE INVENTION

The present invention relates to motor-generator sets for generating electrical energy. The present invention provides for a very compact implementation with low noise level. The new design offers a low profile package with easy access to all components, thereby providing very easy maintainability.

SHORT DESCRIPTION OF THE INVENTION

In the design of the present invention a small air-cooled horizontally mounted diesel engine is used to drive an electrical generator via a coupling. The enclosure includes several cooling air intakes, hot air and exhaust air outlets. A new principle of airflow direction is used to supply sufficient and dedicated cooling air to the various components. By separating the various airflows and by using multiple fans air speed and noise normally connected with high speed airflow is reduced. Surrounding the exhaust of the diesel engine by used cooling air reduces the temperature of the diesel exhaust fumes.

OBJECTS OF THE INVENTION

It is an object of the invention to provide for a motor generator set with a low profile.

It is another object of the invention to provide for a multi-airflow cooling system in electrical generator sets.

It is another object of the invention to provide for a quiet sound-reducing electrical generator set.

It is still another object of the invention to provide for a power unit with uni-body construction and easy access for maintenance.

SHORT DESCRIPTION OF THE FIGURES

DESCRIPTION OF THE PREFERRED EMBODIMENT

Figure 1:
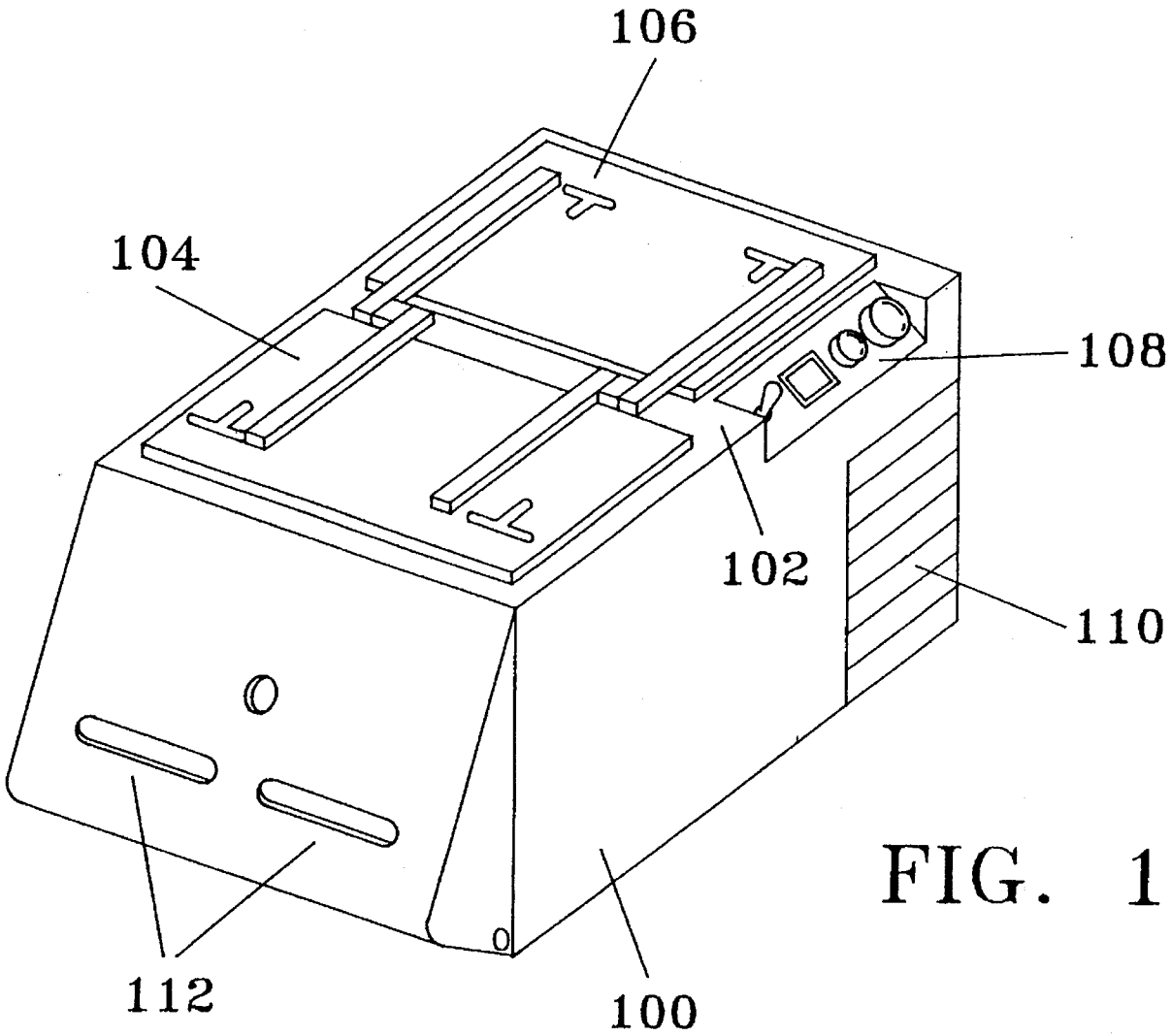
FIG. 1 is an illustration of a Diesel engine driven generator set of the present invention.

FIG. 1 is an illustration of a Diesel engine driven generator set of the present invention. The enclosure of the generator set includes uni-body section 100 with a cover 102 having two lids 104 and 106. A control panel 108 is provided to operate the generator set without having to open lids 104 and 106. Uni-body section 100 5 has an air intake opening 110 and second air intake openings 112. Air entering the generator set through opening 110 is used to cool the cylinder of the engine which drives the electrical generator and for cooling the electrical generator, as will be disclosed in detail with reference to FIG. 3. A part of the same intake air is used by the engine itself. Second air intakes 112 provide cooling air for the general interior, including the oil pan of the driving engine. If required, these openings 112 may provide also cooling air for a separate oil cooler of the driving engine inside uni-body 100.

In the preferred embodiment cover 102 is attached to uni-body by screws in a conventional manner. Cover 102 includes a center spar to which the hinges of lids 104 and 106 are linked. The ends of the center spar are affixed to opposing side walls of enclosure 100. The center spar is of sufficient strength so that a lifting hook may be attached for moving the generator set.

Figure 2:
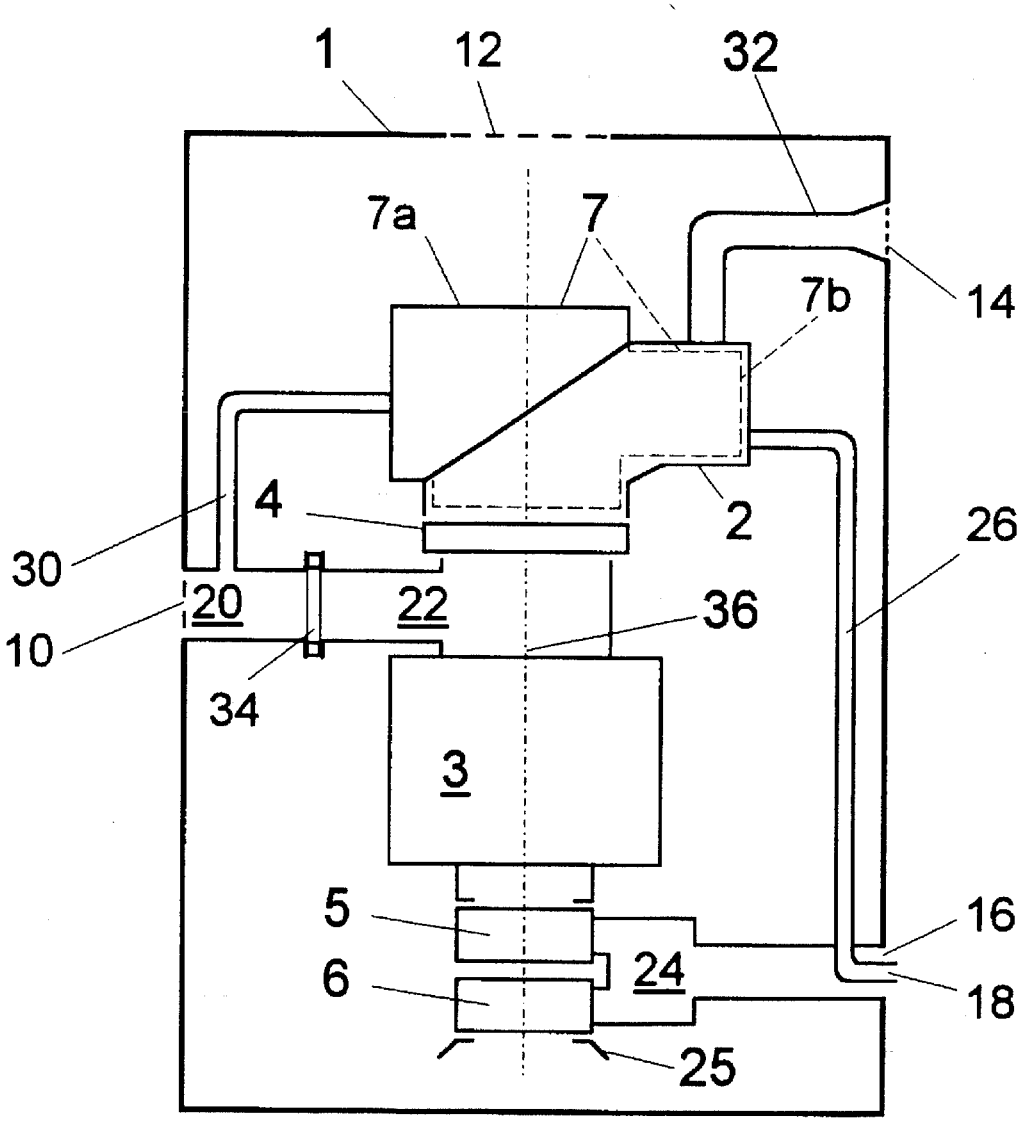
FIG. 2 is a schematic illustration of diesel engine 7 driven generator set of the present invention.
Figure 4:
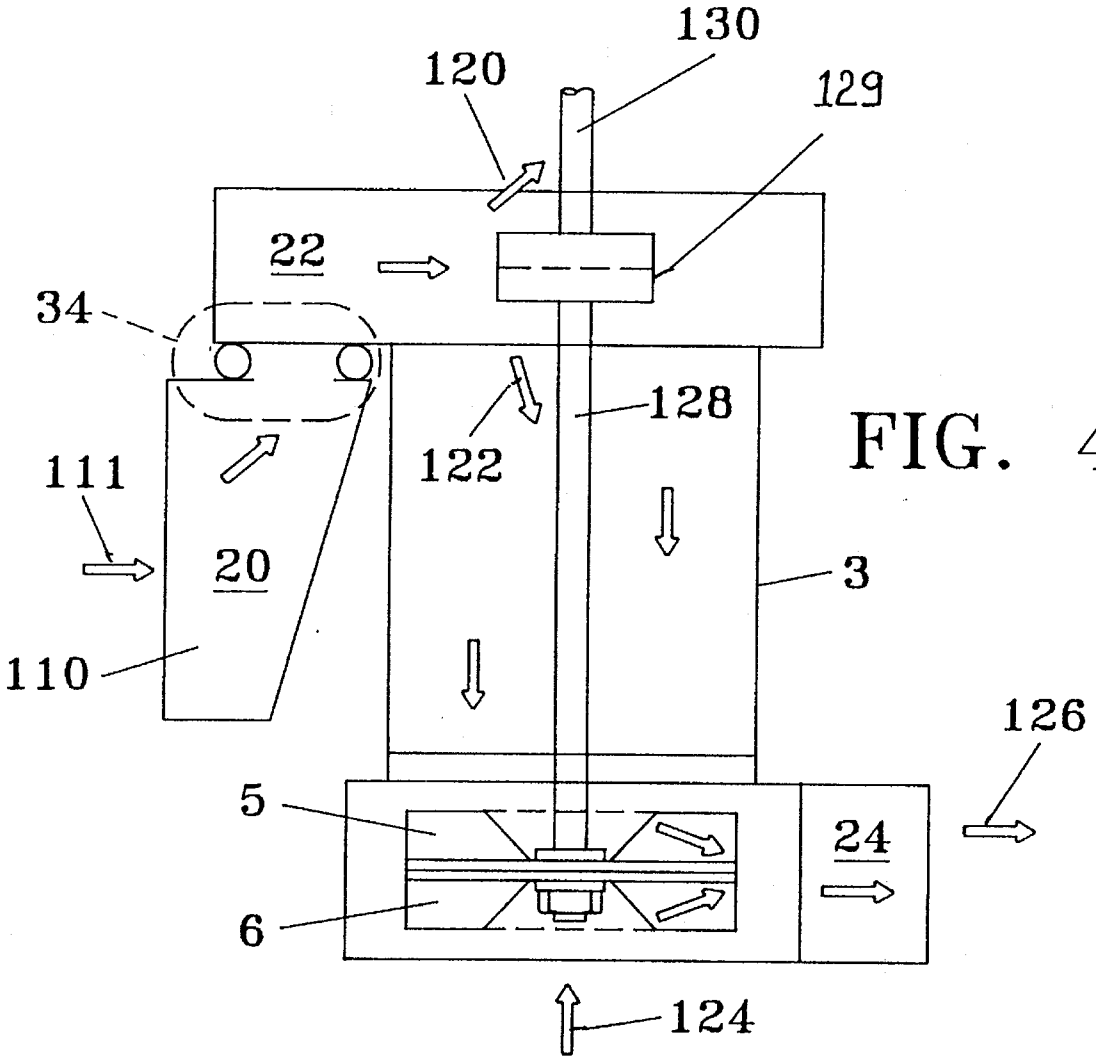
FIG. 4 is another schematic illustration of the dual air-blower unit used for mixing cooling air of the electrical generator and the general internal cooling air of the unit.

FIG. 2 is a schematic illustration of the airflow distribution in the system of the present invention. The diesel generator set of the present invention is mounted inside a main enclosure 1. The Set consists of a flat diesel engine 7, partially enclosed in a shroud 2, coupled to an electrical generator enclosed in a generator enclosure 3. Shroud 2 guides a cooling airflow to the cylinder of diesel engine 7. Reference 36 relates to the common axis of the drive shaft of the internal combustion engine and the shaft of the electrical generator. A first air blower 4, which is a flywheel with appropriate blower blades, is mounted on the drive shaft of diesel engine 7 inside shroud 2. The section of engine 7 not covered by shroud 2 includes a crankshaft case 7*a* including an oil pan at the bottom (farside). The axis of the crankshaft is identified by the line referenced with 38. One end 130 of the crankshaft is shown in FIG. 4. A second air blower 5 and a third air blower 6 are mounted on the free end of the shaft of the electrical generator inside generator enclosure 3. Second air blower 5 and third air blower 6 are radial type blowers and are mounted back to back, which allows to deliver air from two different sources into the same chamber 24, i. e. from inside of generator enclosure 3 and from the interior of main enclosure X but outside of shroud 2 and generator enclosure 3. Blower 5 controls the airflow through generator enclosure 3. Blower 6 has a shroud 25 as an intake means and moves air from the interior of enclosure 1 to mixing chamber 24. The combined airflows of blowers 5 and 6 exit via pipe 16 to outside of envelope 1. The cooling air of diesel engine 7 enters chamber 20 through opening 10, moves into chamber 22. Cooling air in chamber 22 is separated into an airflow for cooling diesel engine 7 and an airflow for cooling the electrical generator covered by shroud 3. The cooling air for diesel engine 7 inside shroud 2 is accelerated by axial blower 4 and exits via pipe 32 through a separate opening 14 in enclosure 1. Diesel engine 7 receives combustion air for operation from chamber 20 via pipe 30. Exhaust fumes are passing through pipe 26 to the outside of enclosure 1. However, pipe 26 is led into cooling air outlet 16 so that the hot diesel exhaust fumes exiting from free end 18 of pipe 26 are enveloped by cooler air of outlet 16. This combined outlet for cooling air and diesel exhaust fumes reduces the temperature of the exhaust fumes and reduces the speed differential between the diesel exhaust fumes and the air outside enclosure 1, thereby reducing also the noise level.

Third air blower 6 draws air from the inside of main enclosure 1. This air enters the inside of main enclosure through an intake 12 and flows around the crankshaft case, the oil pan of engine 7 and shroud 2 cooling parts of diesel engine 7, and generator enclosure 3. Passing through blower 6, which has an intake shroud 25, this third airflow 66 joins the cooling airflow from the electrical generator in plenum chamber 24. At the location where exhaust pipe 26 enters pipe 16 cooling air from blowers 5 and 6 envelops pipe 26. Outside enclosure 1 cooling air exiting at opening 16 envelops exhaust fumes exiting from exhaust pipe opening 18.

Figure 3:
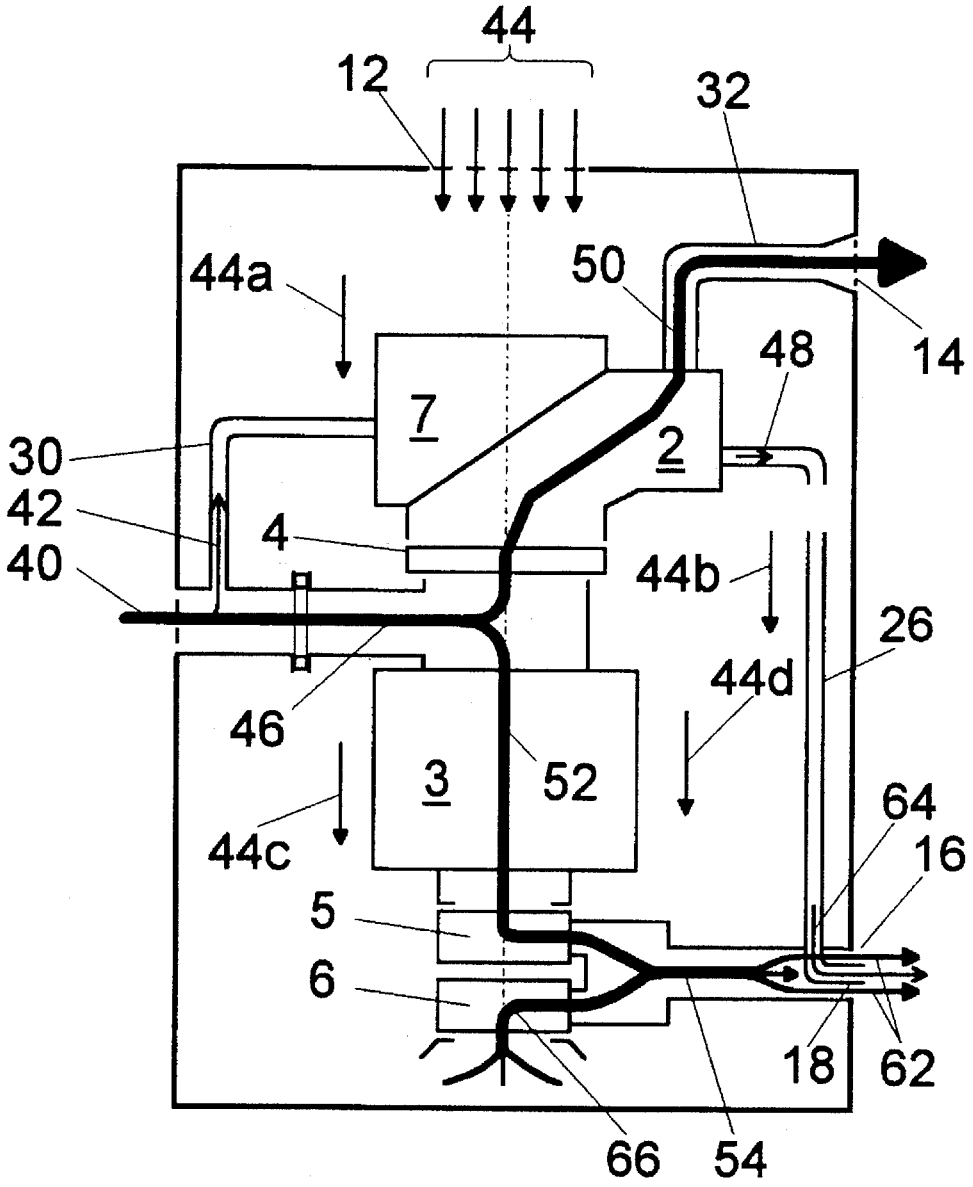
FIG. 3 is a schematic illustration of the airflow distribution in the system of the present invention.

FIG. 3 is a schematic illustration of the airflow of the generator set. There are three major airflows. The first airflow 50 is used to cool the cylinder walls of the internal combustion engine inside shroud 2. The second airflow 52 is used to cool the generator inside generator enclosure 3. First and second airflows are derived from the same airflow 46, which enters the main enclosure as airflow 40. Airflow 40 also includes the supply of combustion air 42 needed by the combustion engine 7. The amount of throughput of first airflow 50 and second airflow 52 is mainly determined by the selection of first blower 4 and second blower 5 and the airflow obstructions in the paths of these airflows.

The third air blower 6 generates airflow 66 from the inside of main enclosure 1. The air of airflow 66 enters the inside of main enclosure 1 through intake 12 as airflow 44 and flows around the crankshaft case, the oil pan of engine 7 and shroud 2 cooling parts of diesel engine 7, and generator enclosure 3 as indicated by arrows 44*a* through 44*d*. Passing through blower 6 this third airflow 66 joins the cooling airflow 52 from the electrical generator in plenum chamber 24. At the location where exhaust pipe 26 enters pipe 16 the combined airflow 54 from blowers 5 and 6 envelops pipe 26 as airflows 62. Outside enclosure 1 cooling air exiting from opening 16 envelops exhaust fumes 64 exiting from exhaust pipe opening 18. Exhaust fumes 48 of diesel engine 7 are already cooled by airflow 62 in flow area 64 before the fumes are released.

Engine 7 may have an additional oil cooler mounted closely against a wall of main enclosure 1. This oil cooler may include a separate air blower. Cooling air for the oil cooler can be diverted from airflow 44 and released through an separate opening to the outside of main enclosure 1. The additional cooling airflow for the oil cooler would reduce the thermal load on airflows 44*a* through 44*d* and increase the total number of airflows to four.

FIG. 4 is another schematic illustration of the dual air-blower unit used for mixing cooling air of the electrical generator and the general internal cooling air of the unit. Air 111 entering the generator set through intake 110 is collected in chamber 20, which is affixed to uni-body 100 (FIG. 1). The air is then entering chamber 22. Chamber 22 is affixed to the combination of engine 7 and generator enclosure 8. Chambers 20 and 22 have an interface 34 which allows near air-tight relative movement between chambers 22 and 24. In chamber 22 cooling air is split into one airflow 120 which cools the cylinder wall of the driving engine and a second cooling airflow 122 for cooling the electrical generator inside shroud 3. An air blower 5 controls airflow 122 and accelerates the air cooling the electrical generator into mixing chamber 24. Air blower 6 collects cooling air 124 from the interior of uni body 100 and accelerates this air into mixing chamber 24. Air of the combined cooling airflow 126 leaves uni-body 100 through opening 16.

As shown in FIG. 4 air blowers 5 and 6 are mounted on the free end of shaft 128 of the electrical generator inside shroud 3. This shaft is coupled to drive shaft 130 of the driving engine by coupling 129. In FIGS. 2 and 3 these shafts are represented by common axis 36.

The use of a flat engine in combination of a direct coupled electrical generator and the use of a plurality of appropriately dimensioned cooling airflows allows to reduce the overall size of the space required for the generator set and thereby reducing the size of the main enclosure, especially the height of the main enclosure.

While the specification discloses a diesel generator set, it is considered to be within the skills of the common practitioner to select an internal combustion engine of a different type to drive the generator without departing from the spirit of the present invention. Engine 7 may be equipped with a hand crank starter or with an electrical starter and a hand crank starter.

What is claimed is:

1. An internal combustion engine generator set comprising a main enclosure;

an internal combustion engine including a shroud;

an electrical generator including a generator enclosure;

a first air blower for generating a first airflow through said shroud for cooling said internal combustion engine;

a second air blower for generating a second airflow through said generator enclosure;

a third air blower for generating a third airflow inside said main enclosure but external to said shroud and said generator enclosure; said first, second and third airflows having airflow exits from said main enclosure;

said internal combustion engine having a combustion air intake and an exhaust fume outlet;

wherein said exhaust fume outlet is combined with at least one of said airflow exits for noise reduction.

2. An internal combustion engine generator set as claimed in claim 1, wherein said internal combustion engine includes an oil pan;

said oil pan being external to said shroud, and wherein said third airflow cools the interior of the main enclosure and said oil pan.

3. An internal combustion engine generator set as claimed in claim 1, wherein said second and said third airflow share one air exit, and wherein said exhaust fume outlet is centrally located inside said shared air exit.

4. An internal combustion engine-generator set comprising a main enclosure;

an internal combustion engine having a drive shaft;

a electrical generator having a rotor shaft;

said drive shaft of said internal combustion engine being coupled to said rotor shaft of said electrical generator for rotation;

said internal combustion engine having an engine shroud for guiding a first cooling airflow, a first air blower wheel mounted on said drive shaft for generating said first airflow, said electrical generator having a generator enclosure for guiding a second airflow, a second air blower wheel and a third air blower wheel mounted on said rotor shaft; said unit body enclosure including a first air intake for providing said first and said second airflow, and combustion air for said internal combustion engine;

said unit body enclosure including a second air intake for providing said a third airflow, said generator enclosure and said engine shroud being connected to said first air intake via a first and a second plenum chamber for receiving air for said first airflow and said second airflow, said second air blower wheel generating said second airflow, said third air blower wheel generating said third airflow from said second air intake through the interior of said enclosure to a third plenum chamber, air of said second and said third airflow being mixed in said third plenum chamber and being released through a first air exhaust, said internal combustion engine having an exhaust pipe with an exhaust tail pipe being mounted inside said first air exhaust, air of said first airflow being released at a second air exhaust;

said first, second and third airflow providing for cooling airflows in according with the particular heat generation of said internal combustion engine, said electrical generator and heat distribution inside said enclosure;

said exhaust tail pipe being located inside said first air exhaust providing for a reduction in exhaust noise.

5. An internal combustion engine-generator set as claimed in claim 4 wherein said main enclosure is of uni-body construction.

6. An internal combustion engine-generator set as claimed in claim 4 wherein said internal combustion engine is a diesel engine.

7. An internal combustion engine-generator set as claimed in claim 4 wherein said first and said second plenum chambers are separated by a vibration absorbing coupling;

and wherein said generator set includes flexible hoses for said combustion airflow, said exhaust fume gas flow and the exits of said first, second and third airflow for reducing vibration transmission from said internal combustion engine and said electrical generator to said main enclosure.

8. An internal combustion engine-generator set as claimed in claim 4, wherein said engine includes an electrical starter and a hand crank starter.

9. An internal combustion engine generator set comprising an internal combustion engine;

an electrical generator coupled to said internal combustion engine; and a main enclosure;

said internal combustion engine generator set having two cooling airflows with separate air blowers for generating said airflows in accordance with heat generation of said internal combustion engine and said electrical generator, and a third airflow with another separate air blower for general cooling in said enclosure.

10. An internal combustion engine generator set as claimed in claim 9, wherein said main enclosure is of uni-body construction including a main body having a top opening with a rim, and a top lid assembly for closing said top opening;

said top lid assembly including a main spar removably mounted across said top opening, and hinged to said main spar two lockable lids;

said lids including weatherstripping for providing a seal between said lids and said rim;

said main spar further including means for lifting said generator set.

11. An internal combustion engine generator set as claimed in claim 10, wherein said main body includes noise reducing padding on the inside surface.

* * * * *